United States Patent [19]

Häfner

[11] Patent Number: 4,651,878

[45] Date of Patent: Mar. 24, 1987

[54] HOLDER FOR A UTENSIL OR SIMILAR OBJECT

[76] Inventor: Rainer Häfner, Herrnstrasse 61, D-6050 Offenbach, Fed. Rep. of Germany

[21] Appl. No.: 869,467

[22] Filed: May 28, 1986

Related U.S. Application Data

[63] Continuation of Ser. No. 641,764, Aug. 17, 1984.

[30] Foreign Application Priority Data

Aug. 26, 1983 [DE] Fed. Rep. of Germany ..... 3330748

[51] Int. Cl.[4] ..... B65D 83/04

[52] U.S. Cl. ..... 206/527; 206/38; 206/45.13; 206/45.15; 15/437; 401/6; 401/99; 401/108; 211/69.1

[58] Field of Search ..... 206/38, 434, 45.13, 206/527, 45.15, 537, 45.18, 45.2, 45.23; 220/334, 337, 335, 339; 401/6, 115, 99, 195, 108; 211/69.1, 69.5, 69.2, 69.7, 69.3, 69.8, 69.4, 69.9; 229/41 R, 41 B; D19/35, 41, 45, 81; 15/437, 438

[56] References Cited

U.S. PATENT DOCUMENTS

| | | | |
|---|---|---|---|
| D. 101,873 | 9/1936 | Tamis | D19/41 |
| D. 145,828 | 10/1946 | White | D19/81 |
| 866,268 | 9/1907 | Edwards | 206/45.18 |
| 2,013,575 | 9/1935 | Moffatt | 206/45.18 |
| 2,020,609 | 11/1935 | Jacka | 206/45.18 |
| 2,568,907 | 9/1951 | Bernstein | 211/69.5 |
| 2,677,494 | 5/1954 | Buttery | 229/41 B |
| 2,722,365 | 11/1955 | Phipps | 206/434 |
| 2,861,734 | 11/1958 | Garman | 229/41 B |
| 3,003,997 | 10/1961 | Intermill | 206/45.18 |
| 3,257,991 | 6/1966 | Mosch | 401/195 |
| 3,262,558 | 7/1966 | Abend et al. | 206/45.15 |
| 3,638,852 | 2/1972 | Solanka | 229/41 B |
| 4,044,980 | 8/1977 | Cummins | 206/45.18 |
| 4,047,017 | 9/1977 | Herring | 401/195 |
| 4,149,812 | 4/1979 | Huffman, Jr. | 401/99 |
| 4,227,823 | 10/1980 | Kitzerow | 401/99 |
| 4,317,638 | 3/1982 | Klaber | 401/195 |
| 4,411,373 | 10/1983 | Kupersmit | 229/41 R |

FOREIGN PATENT DOCUMENTS

| | | | |
|---|---|---|---|
| 135042 | 2/1902 | Fed. Rep. of Germany | 206/45.18 |
| 326059 | 9/1920 | Fed. Rep. of Germany | 206/45.18 |

*Primary Examiner*—Joseph Man-Fu Moy
*Assistant Examiner*—David T. Fidei
*Attorney, Agent, or Firm*—Lane & Aitken

[57] ABSTRACT

Holder for an object which is movable between two positions, with four oblong bar-shaped or cupped movable parts (10, 11, 13, 14), joined together at their respective ends to form a square by hinges (12, 16, 17, 15) having a working range of 180°, 90° and almost 360°. The object to be held (18) is fixed to that hinge (15) which allows the movable parts (13, 14) to revolve within a range of almost 360° in relation to each other. Possible objects include a ball-point, a thermometer, screwdriver.

12 Claims, 1 Drawing Figure

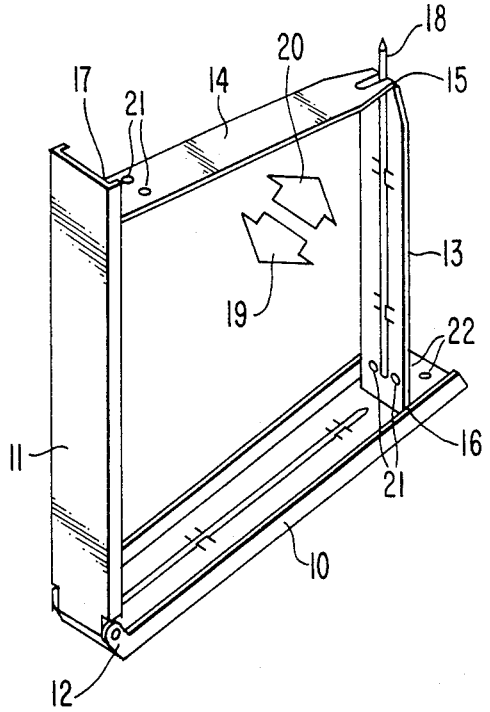
18
20
17
14
15
21
13
19
22
16
11
21
10
12

HOLDER FOR A UTENSIL OR SIMILAR OBJECT

This application is a continuation of application Ser. No. 641,764, filed Aug. 17, 1984.

BACKGROUND OF THE INVENTION

1. Field of the Invention

The invention concerns a device designed to hold an object which is movable between two positions, in particular a utensil or a writing instrument.

2. Discussion of Related Art

It is frequently the case with writing instruments, screwdrivers, utensils and other implements that such devices are intended to be stored in one position and used in another. In the case of a ballpoint pen, for instance, it is desirable for the point of the cartridge not to extend beyond the pen sheath when in the storage position, since clothing could otherwise become soiled when the ball-point pen is worn. The writing position, on the other hand, demands that the ball-point should extend beyond the sheath as a prerequisite to its use for writing purposes.

The invention addresses the problem of providing a holder for an object which is to be moved back and forth between these two different positions. The aim is not simply to move an object from its position of use to its storage position and back, but also to create a holder capable of holding an object in either of two different positions.

This is achieved by a holder of the above mentioned type whose characteristics conform to the features detailed in the claims.

SUMMARY OF THE INVENTION

Basically, the present invention is characterized by oblong parts hinged together in such a way as to form a polygonal ring. In the one position, two hinged parts extend from the other hinged parts in rectilinear relation thereto, whereas in the other position two of the hinged parts enclose the remaining hinged parts.

A practical version of the invention can be constructed using so-called film-type hinge joints, each of the hinged parts being either partly or wholly made of plastic material. For practical purposes, the larger hinged parts are cupped to accommodate the smaller hinged parts in the retracted position so that a ball-point pen could be enclosed between the two larger parts in such a way that it does not project outwards. On opening the device, the hinged parts are moved to the extended position where the ball-point will project beyond the jointed ends of the smaller hinged parts, thus enabling the device to be used for writing.

The following are a few examples of implements and other objects which could be accommodated in this way:

Thermometer, clinical thermometer, pocket watch, alarm clock, magnifying glass, mirror, comb, brush, cosmetic article, cigarette lighter, bottle-opener, penknife, screwdriver, key-holder. Depending on the particular object to be accommodated, the end can be blunt or wedge-shaped. The shape of the hinged arms can be altered as the function demands. In the case of a clock, for instance, the arms would be broader and shorter, the clock itself adopting the function of one of the inner arms, while an axial hinge would take the place of a film-type hinge. Similar alterations are required in the case of a magnifying glass and a mirror.

BRIEF DESCRIPTION OF THE DRAWING

A description of the invention is given below and should be read in conjunction with the drawing.

The drawing shows a diagrammatic view of a holder which corresponds to the invention. The object to be contained in the holder is intended to represent a ball-point cartridge.

DETAILED DESCRIPTION OF A PREFERRED EMBODIMENT

The FIGURE shows the holder in a intermediate position.

One cupped part 10 is connected by a pin-type hinge 12 to a second, essentially identical movable part 11. In the version represented here, these parts are shallow and substantially a rectangular solid in shape, forming between them a hollow space to accommodate parts 13 an 14. Part 13 is connected to the first part 10 by means of a pin-type hinge 16, while part 14 is joined to the second part 11 by a pin-type hinge 17. Both parts 13 and 14 are connected by a film-type hinge joint 15, allowing either of these parts to turn within a range of almost 360° in relation to the other. Parts 13 and 14 are smaller than parts 10 and 11 and take the form of flat bars which fit into the hollow space formed by parts 10 and 11.

A ball-point cartridge 18 is fixed to part 13 in such a way that it can project outwards through an opening in the region of the film-type hinge joint. When the hinged parts are moved to the extended position (in the direction indicated by arrow 20), parts 10 and 11 as well as 13 and 14 will meet, thus enclosing almost the entire length of the ball-point cartridge within a cavity formed between parts 13 and 14. If the hinged parts are moved in the opposite direction (arrow 19), parts 13 and 14 are folded into the space between parts 10 and 11, and finally the two parts 10 and 11 are brought together to form a structure outwardly bounded by the outer surfaces of parts 10 and 11 and enclosing not only the ball-point cartridge 18 but also parts 13 and 14.

The stability of the hinged parts in the extended position can be increased by providing holes 21 in parts 13 and 14 hear hinges 16 and 17 to fit over pin-like projections located correspondingly on parts 10 and 11, thus ensuring that pressure applied to the ball-point cartridge 18 is not transmitted to hinges 16 and 17 but is sustained by the projections 22 and their corresponding openings.

I claim:

1. A holder for an object, said object comprising:

a plurality of parts;

a hinge on each of two opposite ends of each of said parts, each hinge connecting said part to another respective part so that a plurality of hinges connect said parts together to form a ring, a first hinge of said hinges being adapted to rotate through substantially a 360° angle so that two first parts connected by said first hinge can be folded between second and third parts that are connected respectively to said two first parts at respective ends of said first parts opposite said first hinge; and means for mounting the object on one of said two first parts whereby the holder provides a protective cover and a convenient handle for grasping the object.

2. A holder as claimed in claim 1 wherein said first hinge is a film-type hinge.

3. A holder as claimed in claim 1 wherein said first parts and said second and third parts, respectively, are substantially identical to each other in shape.

4. A holder as claimed in claim 1 wherein said second and third parts are larger than said first parts and shaped to enclose said first parts when said first hinge is rotated so that said first parts are between said second and third parts.

5. A holder as claimed in claim 1 wherein said second and third parts are joined to each other by a pin-type hinge rotatable through substantially 180°.

6. A holder as claimed in claim 3 wherein said two first parts are joined to said second and third parts, respectively, by respective pin-type hinges rotatable through substantially 180°.

7. A holder as claimed in claim 1 wherein said means for mounting the object on one of said first parts is shaped to secure a ball point pen cartridge therein along an axis normal to both hinges on said first part and wherein an opening in the other of said first parts and said first hinge permits the tip of said ball point pen cartridge to pass therethrough as said first hinge rotates through substantially a 360° angle.

8. A holder as claimed in claim 1 wherein said parts are each substantially a shallow rectangular solid in shape.

9. A holder as claimed in claim 1 having parts that are each a semicylindrical solid in shape.

10. A holder as claimed in claim 1 wherein said parts are made of a plastic material.

11. A holder as claimed in claim 1 wherein said first hinge is a pin-type hinge and said means for mounting the object is shaped to secure a clock mechanism therein, whereby said clock assembly comprising said clock mechanism and said first part having said means for mounting the object functions as one of said first parts.

12. A holder as claimed in claim 4 wherein said second and third parts are engaged with respective first parts by projection and aperture means located near said second and third hinges on said respective parts when said first parts are fully extended out from said second and third parts, whereby the stability of said parts in this extended position is increased thereby preventing pressure applied to the parts from being transmitted to the hinges whereby a secure handle is provided for the object.

* * * * *